US005356314A

United States Patent [19]

Aota

[11] Patent Number: 5,356,314

[45] Date of Patent: Oct. 18, 1994

[54] DOUBLE-SOCKET ELECTRIC LAMP CONTAINING A LOW-VOLTAGE HALOGEN LIGHT SOURCE, TRANSFORMER FOR THE SAME, AND A FIXING ARRANGEMENT OF THEM

[75] Inventor: Jiro Aota, Himeji, Japan

[73] Assignee: Minoru Nishibori, Kasai, Japan

[21] Appl. No.: 58,334

[22] Filed: May 10, 1993

[30] Foreign Application Priority Data

Apr. 12, 1993 [JP] Japan ..... 5-110108

[51] Int. Cl.[5] ..... H01R 33/94

[52] U.S. Cl. ..... 439/642

[58] Field of Search ..... 439/628, 642, 643; 313/580

[56] References Cited

U.S. PATENT DOCUMENTS

| | | | |
|---|---|---|---|
| 4,039,821 | 8/1977 | Greene et al. | 439/642 X |
| 4,407,560 | 10/1983 | Williams | 439/642 |
| 4,688,874 | 8/1987 | Björkman | 439/642 X |
| 4,750,892 | 6/1988 | Santopietro | 439/642 X |

*Primary Examiner*—Eugene F. Desmond

*Attorney, Agent, or Firm*—Edwin E. Greigg; Ronald E. Greigg

[57] ABSTRACT

In a double-socket electric lamp containing a low-voltage halogen light source to fit in a secondary socket of a commercial supply voltage controlled by a transformer device to fit in an existing primary socket for a commercial power source; the double-socket electric lamp comprises a root inserted in the secondary socket, the root having an indentation in a position opposed to a projected electrode at the bottom of the secondary socket, and an electrode formed in the indentation that comes in contact with an end of the projecting electrode of the secondary socket. The transformer device for the double-socket electric lamp containing a low-voltage halogen light source comprises a primary base to fit in an existing primary socket connected to a commercial power source, a transformer for decreasing the commercial supply voltage to a voltage suitable for use in the double-socket electric lamp, and a secondary socket to fit on a root of the double-socket electric lamp, having a projecting electrode fixed therein; the projecting electrode of the secondary socket being in contact with an electrode in the indentation formed in the root of the double-bulb electric lamp.

6 Claims, 4 Drawing Sheets

FIG. 2a
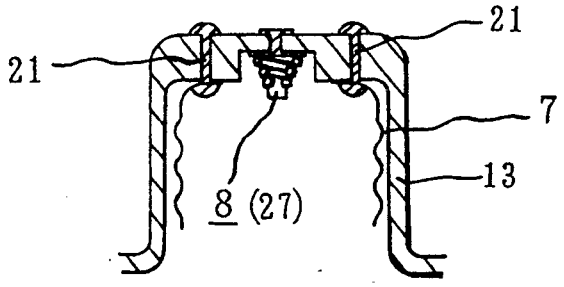
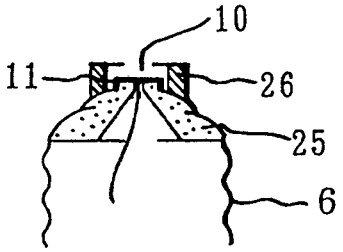
FIG. 2b

FIG. 3a
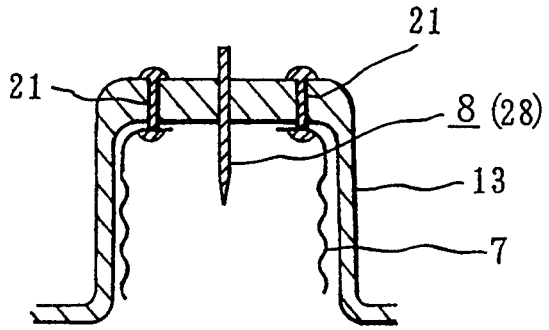
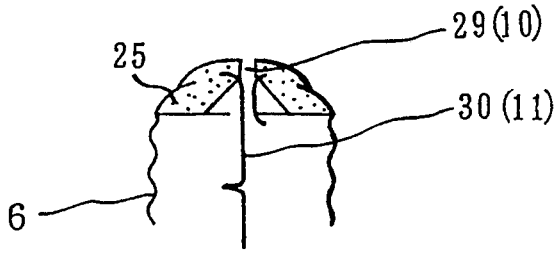
FIG. 3b

FIG. 4a
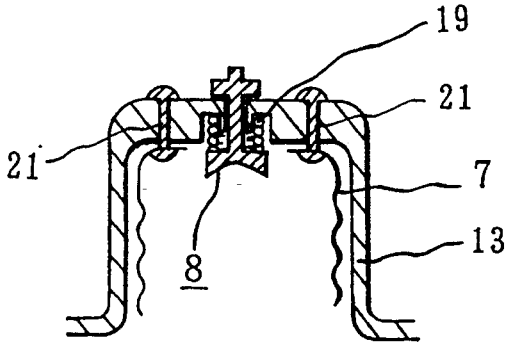
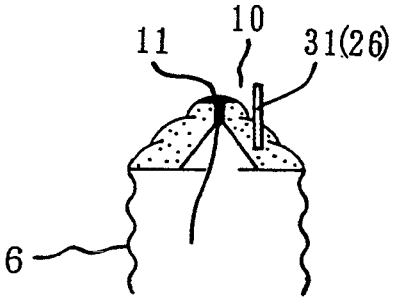
FIG. 4b

DOUBLE-SOCKET ELECTRIC LAMP CONTAINING A LOW-VOLTAGE HALOGEN LIGHT SOURCE, TRANSFORMER FOR THE SAME, AND A FIXING ARRANGEMENT OF THEM

BACKGROUND OF THE INVENTION

The present invention relates to a double-socket electric lamp containing a low-voltage halogen light source, a transformer for the lamp, and a supporting arrangement of a secondary socket for receiving the double-socket electric lamp and the transformer.

An incandescent lamp has long been used for general indoor illuminants, and at present a halogen lamp is one of the most popular illuminants used for special purposes like a headlight in an automobile, a light source of a copying machine, and various illuminators for shops.

A 100 V-or-under low-voltage halogen lamp is more efficient than an ordinary incandescent lamp used at commercial voltage and deemed to be an energy-saving alternative to conventional incandescent lamps; also in the future halogen lamps will be one of the primary illuminants which will replace the incandescent lamp.

With the same electric power demanded, for example, a 12 V halogen lamp is higher in brightness by 40% or more than a 120 V incandescent lamp; and higher by 15% or more than a 100 V halogen lamp.

Besides, there are further advantages that the 12 V halogen lamp has a lifetime three times as long as that of the incandescent lamp because a thicker and shorter filament may be used compared with a filament used in a 120 V incandescent lamp and the inside of its glass bulb can be pressurized, and that adjustment of the light in the halogen lamp is facilitated because the halogen lamp is sized smaller, having a point light source, than the incandescent light.

However, the halogen lamp cannot be an alternative to the incandescent lamp until a transformer is used to reduce voltage from a 100 V to 120 V commercial voltage to a specified voltage (e.g., 12 V) suitable for use in the low-voltage halogen lamp. In addition to that, the halogen lamp is completely different in appearance from the ordinary incandescent lamp, and it is not well-known for general use.

Such a use of a low-voltage halogen lamp will be wide spread as an alternative of the incandescent lamp among consumers if it is shaped similar to the conventional incandescent lamp. For that purpose, it is desirable that its glass bulb and base are the same as those of the conventional incandescent lamp, and a double-socket electric lamp containing a low-voltage halogen light source is a general mode of the desirable alternative to the conventional incandescent lamp.

However, it is fully expected that a halogen lamp, shaped like the conventional incandescent lamp and used at a voltage as low as 12 V may be erroneously fitted directly into a conventional primary socket (120 V to 100 V) in the replacement of a bulb. In such a case, excessive voltage applied to the filament of the halogen lamp to cause an arc discharge, and an inner gas will rapidly expand. Consequently, the bulb explodes, and pieces of glass scattered by the explosion may hurt people therearound. In order to prevent an accident as stated above, something must be devised so that erroneous insertion of any double-socket electric lamp containing a low-voltage halogen light source into the primary socket will prevent any power supply to light the lamp.

Accordingly, it is an object of the present invention to provide a double-bulb electric lamp containing a low-voltage halogen light source which is not supplied with power nor lighted if it is erroneously fitted directly into a conventional primary socket in the replacement of a well known bulb.

It is another object of the present invention to provide a transformer having both a primary base to fit into a primary socket connected to a commercial power source and a secondary socket to fit on a base of a double-socket electric lamp containing a low-voltage halogen light source, for reducing commercial voltage to a voltage suitable for use in the double-socket electric halogen lamp.

It is still another object of the present invention to provide a fixing arrangement of the base of the double-socket electric lamp and the secondary socket of the transformer.

SUMMARY OF THE INVENTION

In an aspect of the present invention in a double-socket electric lamp (A) containing a low-voltage halogen bulb for producing a light source which is fitted in a secondary socket (7) of a transformer device (B) for reducing a commercial supply voltage, which, in turn, is fitted in an existing primary socket (2) for a commercial power source; a base (9) that is inserted in the secondary socket (7) has an indentation (10) in a position opposed to a projecting electrode (8) at the bottom of the secondary socket (7), and an electrode (11) in contact with a tip of the projecting electrode (8) is formed in the indentation.

As mentioned above, the electrode (11) is formed in the indentation (10) for safety in such a manner that a primary electrode (12) of the primary socket (2) is not in contact with the electrode (11) in the indentation (10) if the double-socket electric lamp (A) containing a low-voltage halogen light source is fitted into the existing primary socket (2) for the commercial power source.

In a second aspect of the present invention, a transformer device (B) for a double-socket electric lamp containing a low-voltage halogen light source includes a primary base that fits into an existing primary socket (2) connected to a commercial power source (1). The transformer (5) reduces a commercial supply voltage to a voltage suitable for use in a double-socket electric lamp (A) containing a low-voltage halogen light source, and a secondary socket (7) fits on the double-socket electric lamp; a projecting electrode (8) is formed in the secondary socket (7) so that it comes in contact with an electrode (11) in an indentation (10) formed in a base (9) inserted in the secondary socket (7).

As mentioned above, the projecting electrode (8) is formed in the transformer device (B) for safety in such a manner that the electrode (8) does not come into contact with the electrode (11) in the indentation (10) of the double-socket electric lamp (A) until the double-socket electric lamp (A) is fitted in the transformer device (B), and therefore, the electrode (11) will never come into contact with a primary electrode (12) of the primary socket (2) if the double-bulb electric lamp (A) is erroneously fitted in the existing primary socket (2) for a commercial power source.

In a third aspect of the present invention, in an arrangement for connecting a double-socket electric lamp (A) containing a low-voltage halogen light source to a secondary socket (7) of a transformer device (B), where the double-socket electric lamp (A) contains a low-voltage halogen light source (4) therein and has a lamp base (6) to fit in the secondary socket (7) of the transformer device (B), the transformer device (B) includes a primary base (3) to fit in an existing primary socket (2) connected to a commercial power source (1), a transformer (5) for decreasing a commercial supply voltage to a voltage suitable for use in the double-socket electric lamp (A), and the secondary socket (7) fits on the lamp base (6) of the double-socket electric lamp (A); the connecting arrangement includes a projecting electrode (8) formed at the bottom of the secondary socket (7). The lamp base (6), which is provided at a base (9) of the double-socket electric lamp (A) is inserted into the secondary socket (7) and is shaped similar to the primary base (3), fits in the secondary socket (7), and an electrode (11), which is fixed to an indentation (10) formed in the base (9) of the double-socket electric lamp (A) opposed to the projecting electrode (8), fits on a part of the projecting electrode (8) so as to be in contact with the projecting electrode 8.

When the base (6) of the double-Locket electric lamp (A) is fitted in the secondary socket (7) of the transformer device (B), the projecting electrode (8) at the bottom of the secondary socket (7) comes into contact with the electrode (11) of the lamp base (6) to supply power to light the lamp. If the double-socket electric lamp (A) is erroneously inserted in the primary socket (2), a primary electrode (12) at the bottom of the primary socket (2) is merely in contact with an edge of the indentation (10) formed in the center of the base (9) of the double-socket electric lamp (A) without being in contact with the electrode (11) in the indentation (10), and the low-voltage halogen light source (4) inside the double-socket electric lamp (A) does not light up.

Thus, the double-socket electric lamp (A) containing a low-voltage halogen light source can be treated very securely with an appearance similar to the conventional incandescent lamp.

BRIEF DESCRIPTION OF THE DRAWINGS

FIG. 2*a* is a partial sectional view showing a lamp base and FIG. 2*b* is a secondary socket of a second preferred embodiment according to the present invention without fixing them to each other;

FIG. 3*a* is a partial sectional view showing a lamp base and FIG. 3*b* is a secondary socket of a third preferred embodiment according to the present invention without fixing them to each other; and FIG. 4*a* is a partial sectional view showing a lamp base and FIG. 4*b* is a secondary socket of a fourth preferred embodiment according to the present invention without fixing them to each other.

DESCRIPTION OF THE PREFERRED EMBODIMENT

Figure 1:
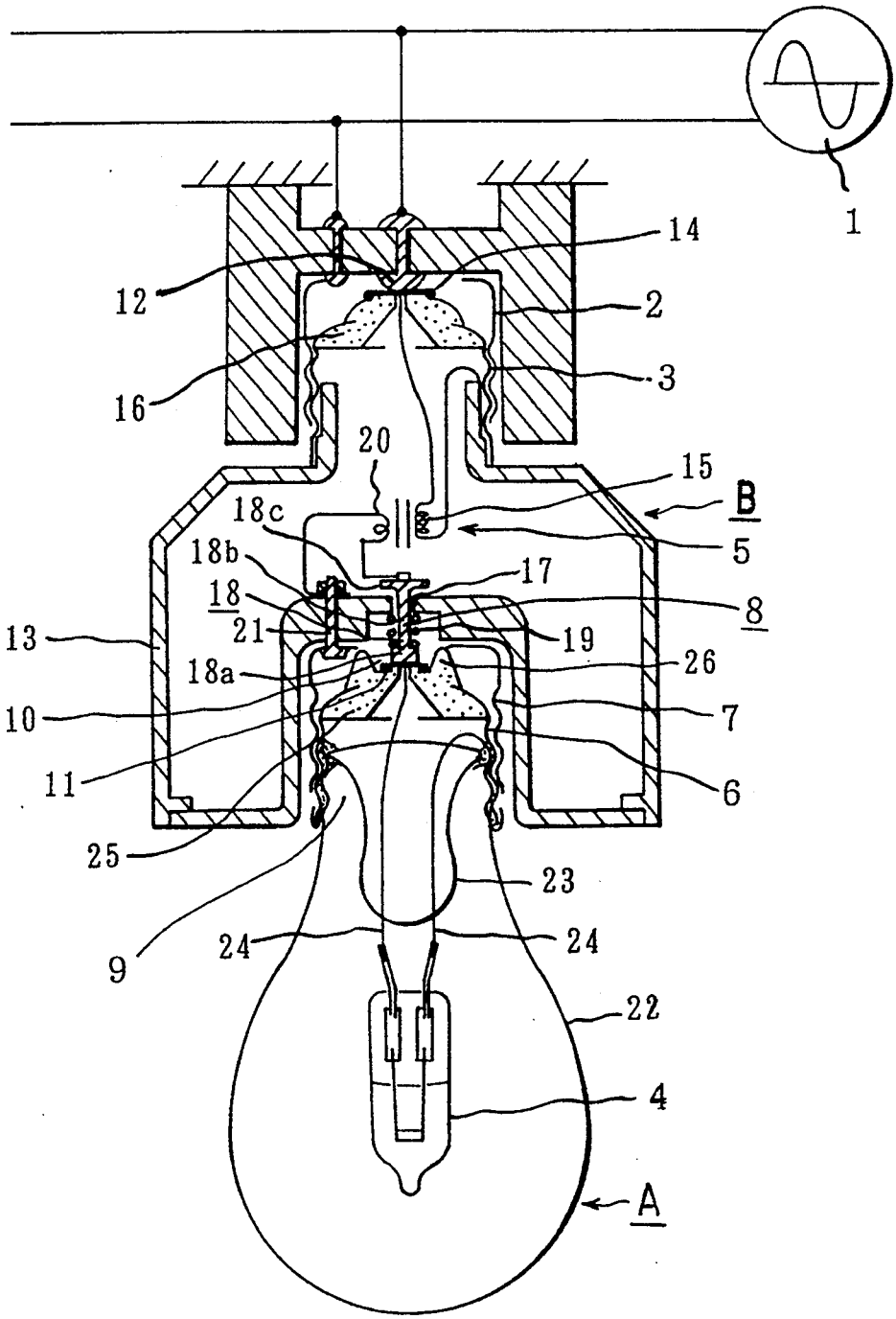
FIG. 1 is a front sectional view of a double-socket halogen lamp and a transformer device of a first preferred embodiment according to the present invention with the parts fixed to each other.

The present invention will now be described in detail in conjunction with its preferred embodiments illustrated in the accompanying drawings. FIG. 1 is a front sectional view showing a double-socket electric lamp (A) containing a low-voltage halogen light source (4) that fits in a transformer device (B) according to the present invention.

The transformer a (B) includes device body (13), a primary base (3), a transformer (5) for reducing a commercial supply voltage to a voltage suitable for use in the lamp (A), and a secondary socket (7) which receives the lamp base (6) of the lamp (A). The transformer device body (13) is cylindrical in shape and includes the transformer therein. The transformer (5) is well known in the art, used for reducing the commercial supply voltage to a voltage suitable for use in the amp (A), and a detailed description on its configuration is omitted.

A primary base (3) is provided in one end of the transformer device body (13), projecting from it. In the center portion of the end of the primary base (3), a primary center electrode (14) is provided in an insulated state, and primary coil (15) of the transformer (5) is connected to the primary center electrode (14) and the primary base (3). A primary insulator (16) is molded over a rim of the primary base (3) and is useful to electrically isolate the primary center electrode (14) from the primary base (3).

A shape of the primary base (3) is determined so that the base (3) can be fitted into an existing primary socket (2) connected to a commercial power source. In other words, that which is identical in shape to a base of a conventional incandescent lamp is used.

The secondary socket (7) is fitted in a hollow formed in a surface of another end of the transformer device body (13), and a projecting electrode (8) is fixed in the center portion of the hollow, isolated from the secondary socket (7). FIG. 1 depicts an example of the projected electrode (8), and an electrode rod (18), which is a main part of the projected electrode (8), slidably extends in a through-hole (17) formed in the center of the hollow. A coil spring (19) extending between a knob (18*a*) of the electrode rod (18) and the bottom of the hollow forces the electrode rod (18) toward its knob (18*a*). The electrode rod (18) is comprised of the knob (18*a*) which is larger in diameter that an axial part (18*b*), the axial part (18*b*) integrally extends from the knob (18*a*), and a stopper shoulder (18*c*) formed in an end opposite to the knob (18*a*), and the knob (18*a*) comes in contact with an electrode (11) of the lamp (A) as mentioned later.

A secondary coil (20) of the transformer (5) is connected to the stopper shoulder (18*c*) of the electrode rod (18) and a fixing pin (21) for fixing the secondary socket (7) in the hollow of the transformer device body (13), respectively.

Main components of the double-socket electric lamp (A) include the low-voltage halogen light source (4), an outer bulb (22) and a lamp base (6).

For the low-voltage halogen light source (4), a well-known single-end type halogen lamp is preferable which is generally used with a rated voltage of 12 V, for example. The halogen light source (4) should not be limited to the illustrated embodiment; several other well-known types like a double-end type may be used, and the rated voltage should also not be limited to 12 V through halogen light sources of 100 V or under in rated voltage should be used.

For the outer bulb (22), various kinds of bulbs usually used for an incandescent lamp, such as a transparent type, a frost type, etc. A shape of the bulb should not be limited to that illustrated in the drawings.

A step (23) is fused to an inner base of the outer bulb (22), and a lead-in wire from the low-voltage halogen light source (4) is used to one end of a stem fixed lead (24) extending in the stem (23) and fixed thereto. This allows the low-voltage halogen light source (4) to be held in position inside the outer bulb (22).

A connecting arrangement of the lamp base is shaped similar to the primary base (3), and it is attached to an open end of the outer bulb (22) and constitutes a base (9). The center portion of the lamp base (6) defines an opening, and a secondary insulator (25) is molded over the opening. An indentation (10) is formed in a surface of the molded insulator opposite to the projecting electrode. An annular projection (26) defines the indentation (10) and the electrode (11) is provided in the indentation (10). Thus, the electrode (11) is positioned deeper than the annular projection 26. A small aperture surrounds the electrode (11) and is provided in the secondary insulator (25), and one end of the stem fixed lead (24) is welded to the electrode (11) and the other end is welded to the lamp base (6).

The outer bulb may be either filled with inert gas or in a vacuum state.

Thus, the primary base (3) of the transformer device (B) is inserted and fitted in the primary socket (2) connected to the commercial power source (1). Next, the lamp base (6) of the double-socket electric lamp (A) containing the low-voltage halogen light source is fitted in the secondary socket (7) of the transformer device (B). In this case, the knob (18*a*) of the electrode rod (18) of the projecting electrode (8) is smaller in inner diameter than the indentation (10), and therefore, it extends into the indentation (10) and is forced by pressure of the spring to be in contact with the electrode (11). This causes the transformer (5) to work to reduce the commercial voltage to the rated voltage of the low-voltage halogen light source (4), and finally, the low-voltage halogen light source (4) safely lights up.

Then, a case where the double-socket electric lamp (A) is erroneously inserted in the primary socket (2) will be described below. The primary socket (2) has a primary electrode (12) fixed at its bottom as shown in FIG. 1, and an outer diameter of the primary electrode (12) is larger than the inner diameter of the indentation (10) of the double-socket electric lamp (A). Thus, when the double-socket electric lamp (A) is fitted in the primary socket (2), the annular projection (26) prevents the primary electrode (12) from extending into the indentation (10) and being in contact with the electrode (11). Hence, if the double-socket electric lamp (A) is erroneously inserted in the primary socket (2), primary voltage (100 V or 120 V) is not applied to the low-voltage halogen light source (4), and there is no danger of an accidental explosion.

FIGS. 2*a* to 4*b* depict other embodiments of a secondary socket according to the present invention; FIG. 2*a* shows an example where a volute spring (27) in contact with a center electrode is used as an alternative to the projecting electrode (8). The tip of the volute spring (27) comes into the indentation (10) to be in contact with the electrode (11) shown in FIG. 2*b*.

FIG. 3*a* depicts a case where a pin (28) is used as an alternative to the projecting electrode (8), where a retaining grip (30) is provided along an electrode through-hole (29) defined at the end of the base (9) of the lamp (A) shown in FIG. 3*b* so that the pin electrode (28) inserted in the electrode through-hole (29) is elastically retained by the retaining grip (30). In this case, the electrode through-hole (29) and the retaining grip (30) are employed instead of the indentation (10) and the electrode (11), respectively.

FIGS. 4*a* and 4*b* illustrate another variation of an example where a pin (31) of greater length than the electrode (11) is erected beside the electrode (11), and the electrode rod (8) is forced by the coil (19) to come into contact with the electrode (11). In this case, the pin (31) functions similar to the annular projection (26) shown in FIGS. 1 and 2*b*; that is, the pin (31) is in contact with the bottom of the primary socket (2) to prevent the electrode (11) and the primary electrode (12) from being in contact with each other when the lamp (A) is erroneously inserted in the primary socket (2).

While the invention has been shown and described in detail, the foregoing description is in all aspects illustrative and not restrictive. It is therefore understood that numerous modifications and variations can be devised without departing from the scope of the invention.

What is claimed is:

1. A transformer for connecting a commercial power source with a low-voltage halogen light bulb, comprising:

a housing having a primary base that fits into an existing primary socket connected to said commercial power source which completes an electrical circuit with said commercial power source;

a transformer within said housing connected electrically with said base for decreasing a commercial supply voltage of said commercial power source to a voltage suitable for use in supplying current to said low-voltage halogen light bulb;

said housing including a secondary socket opposite said primary base that receives a base of the low-voltage halogen light bulb, said second socket having a central projecting electrode therein;

said base of said low-voltage halogen light bulb having a central indentation therein with a central contact for making an electrical contact with said central projecting electrode of said secondary socket.

2. A transformer as set forth in claim 1 wherein said central projecting electrode in said secondary socket is spring loaded toward said central contact of said base of said low-voltage halogen light bulb.

3. A transformer as set forth in claim 1 in which said central projecting electrode is an elongated pin and said central contact in said base of said low-voltage halogen light bulb is formed by an opening with a pin grip device in combination with said opening.

4. A low-voltage halogen light bulb for connecting with a primary base of a transformer to complete an electrical circuit, which comprises:

a base, said base having a central indentation;

a central electrode in said central indentation;

a first bulb connected with said base, a second bulb within said first bulb;

said second bulb having a filament and halogen gas therein;

electrical lines connected at one end with said filament and connected at another end via said base and said central electrode with electrical contacts in said primary base of said transformer.

5. A low-voltage halogen light bulb as set forth in claim 4, wherein said first bulb contains a pressurized gas.

6. A low-voltage halogen light bulb asset forth in claim 4, wherein said first bulb contains a vacuum.

* * * * *